United States Patent [19]

Sedley

[11] 4,312,198

[45] Jan. 26, 1982

[54] MAGNETIC KEY OPERATED HOTEL DOOR LOCK

[76] Inventor: Bruce S. Sedley, R.R. 1, Box 96, Koloa, Hi. 96756

[21] Appl. No.: 65,267

[22] Filed: Aug. 9, 1979

[51] Int. Cl.[3] ..... E05B 13/10; E05B 19/00; E05B 35/08; E05B 47/00

[52] U.S. Cl. ..... 70/276; 70/222; 70/382; 70/395; 70/400; 70/413; 70/423; 70/432

[58] Field of Search ..... 70/276, 413, 432, 384, 70/395, 382, 385, 398, 400, 423

[56] References Cited

U.S. PATENT DOCUMENTS

| | | | |
|---|---|---|---|
| 1,587,686 | 6/1926 | Varnum | 70/400 X |
| 1,896,319 | 2/1933 | Littell et al. | 70/382 |
| 1,917,302 | 7/1933 | Hill | 70/384X |
| 3,128,618 | 4/1964 | De Vines | 70/432 X |
| 3,271,983 | 9/1966 | Schlage | 70/276 |
| 3,444,711 | 5/1969 | Sedley | 70/276 |
| 3,680,336 | 8/1972 | Schendel | 70/276 |
| 3,705,277 | 12/1972 | Sedley | 70/276 X |
| 3,834,197 | 9/1974 | Sedley | 70/276 X |
| 3,948,068 | 4/1976 | Stackhouse | 70/276 |
| 3,995,460 | 12/1976 | Sedley | 70/413 X |
| 4,133,194 | 1/1979 | Sedley et al. | 70/276 X |

FOREIGN PATENT DOCUMENTS

| | | | |
|---|---|---|---|
| 2138991 | 2/1973 | Fed. Rep. of Germany | 70/413 |
| 2433918 | 2/1976 | Fed. Rep. of Germany | 70/395 |

OTHER PUBLICATIONS

"Locksmith Ledger," vol. 37, No. 8, Jul. 1977; pp. 73–81, with p. 81 in particular (Nickerson & Collins Co., Des Plaines, IL 60018).

*Primary Examiner*—Roy D. Frazier
*Assistant Examiner*—Carl F. Pietruszka

[57] ABSTRACT

A mechanical magnetic key operated door lock structure particularly adapted for use in hotel locksets. An occupancy indicator is incorporated in the lock structure to indicate that the lockset is locked from the inside, thus insuring privacy for the hotel guest. In addition, means operable from outside the lock structure is provided for changing the combination of the lock so that a newly arriving guest may be provided with a key having a different combination from that used by the previous guest.

20 Claims, 7 Drawing Figures

MAGNETIC KEY OPERATED HOTEL DOOR LOCK

This invention relates to a mechanical magnetic key operated door lock and is particularly directed to a lockset adapted for use on the guest rooms of hotels. One requirement of a hotel lockset is that an occupancy indicator be provided therein to indicate to a maid or others that the door is locked from the inside as well as from the outside (double locked) and the room is presumed to be occupied and that no attempt should be made to enter the room. The conventional type of occupancy indicator includes a relatively small pin which is projected outwardly of the outer wall of the outside knob when a push button on the inner knob is depressed by the guest. Such depression of the inner button simultaneously double locks the lockset against an unlocking key or a master key. Such occupancy indicators for conventional locksets are well known in the art and one is disclosed in U.S. Pat. No. 3,128,618.

One of the objects of the present invention is the provision of an occupancy indicator in a magnetic key operated door lock and especially one of the type disclosed in U.S. Pat. No. 4,133,194. Said patented structure is adapted to be actuated by a magnetic key of the type disclosed in U.S. Pat. No. 4,077,242. Reference is made to said patented structures for details not herein disclosed.

In the key operated structure of U.S. Pat. No. 4,133,194 it is extremely desirable to be able to change the combination of the lockset so that an arriving guest may be provided with a key differing in its combination from the key used by the previous guest. This feature, of course, provides greatly added security for the new guest. Another object of this invention is therefore to provide not only a means for changing the combination of a lockset to adapt it for use with a new key but to permit such a change to be performed rapidly from outside the lockset without requiring any disassembly of the latter or removal of the outer knob from the lockset spindle.

Still another object of the invention is the provision of code changing means as above described which does not require the use of the old key or the new key.

Other objects and advantages will be apparent from the following specification and from the drawings.

Figures 1, 2, 3, 4, 5, 6, 7:
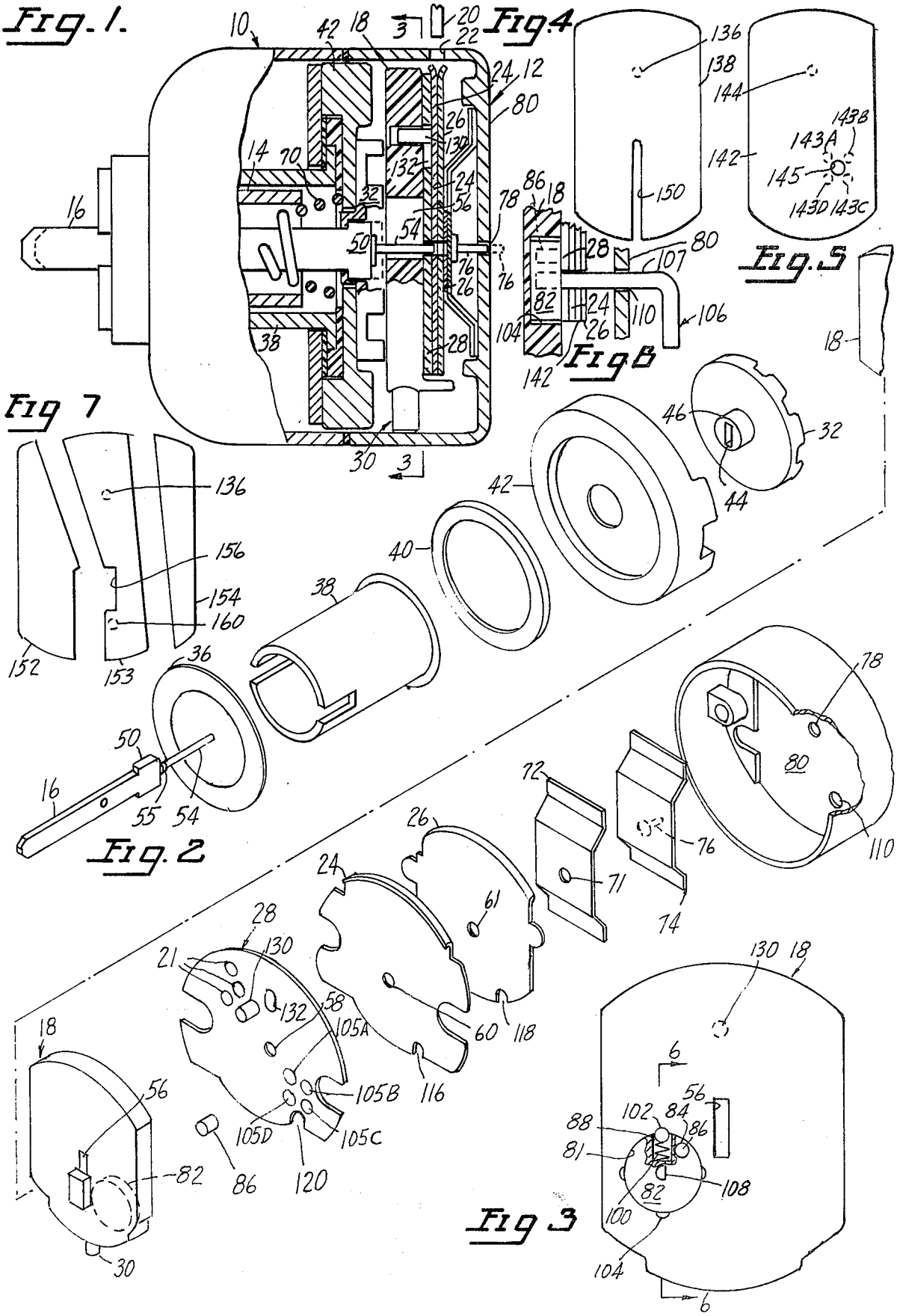
FIG. 1 is a side elevation partly in section of an outer knob structure of a magnetic key operated door lock suitable for hotel use.
FIG. 2 is an exploded isometric of the essential elements of the structure of FIG. 1.
FIG. 3 is a cross sectional view through the housing of FIG. 1 showing only the slidable core.

FIG. 4 is a side elevation of a key of the type disclosed in U.S. Pat. No. 4,077,242 but showing a modification thereof.

FIG. 5 is a similar view of a key showing a modification thereof adapting the key for use as a code changing key.

FIG. 6 is a fragmentary cross section of the slidable core of FIG. 1 taken in a plane indicated by lines 6—6 of FIG. 3 and showing the operation of the code change pin carrier.

FIG. 7 is a side elevation of an emergency master key which is formed in a plurality of parts to provide added security.

First with reference to FIG. 1 the general structure disclosed therein is somewhat similar to that disclosed in U.S. Pat. No. 4,133,194 to which reference is made for details not herein disclosed.

This structure includes a modified knob generally designated 10 and a housing generally designated 12. Said knob and housing being mounted on the conventional door knob spindle 14. The inner knob structure is not shown herein since the same is conventional and well known in the art. By which such well known structure a driver bar or tail piece 16, upon its rotation, unlocks the lockset by retraction of the door latch (not shown).

Although most of the details of construction are shown in the above noted U.S. Pat. No. 4,133,194, a short description of the operation of the lock is as follows:

A slidable core 18 is adapted to be translated downwardly from its upper locked position shown in FIG. 1 by means of a properly coded key indicated at 20 which may be inserted through a slot 22 in the sidewall of housing 12. The key 20 is inserted between a nonmagnetic cover plate 24 and a magnetizable shield plate 26 so that locking pins in slidable core 18 are magnetically ejected out of corresponding openings in a locking plate 28 which is fixed relative to the housing 12. To simplify the drawings the locking pins which are located in slidable core 18 in positions to correspond with the magnetic spots on key 20 are not shown herein but the operation of the same is clearly disclosed in U.S. Pat. No. 4,133,194. A few holes 21 in locking plate 28 are indicated in FIG. 2. A predetermined number of such holes are adapted to receive therein such locking pins.

When the locking pins have been retracted back into core 18 out of engagement with locking plate 28 the core 18 may be moved by the key 20 downwardly against the resiliency of a spring pressed foot generally designated 30. This sliding movement of core 18 connects for rotation the core 18 and a gear-like plate 32 so that plate 32 upon rotation of housing 12 rotates the tail piece 16 to unlock the lockset.

Referring to FIG. 2, it is seen that the tail piece 16 passes axially through a washer 36, a sleeve 38 another washer 40, a relatively heavy plate 42 and into an opening 44 formed in a boss 46 integral with the gear plate 32.

By the present invention the tail piece 16 is provided at its outer end with an enlarged rectangular end portion 50 which is received within a complementarily formed slot in gear 32. It will be seen from FIG. 1 that the tail piece may be moved to the right from its full-line position to its dotted line position without interference with any of the above noted parts. By the present invention an elongated pin 54 preferably provided with an upset end 55 is secured to the inner end of tail piece 16. This pin 54 extends through a vertically elongated slot 56 in core 18, through an opening 58 in locking plate 28 and into a hole 60 in cover plate 24.

Secured at one of its ends to tail piece 16 is a conical spring 70 (FIG. 1) which bears at its other end against heavy plate 42. By this structure it will be seen that tail piece 16 may be moved to the right against the resiliency of spring 70 so that the free end of pin 54 extends through a hole 61 in shield plate 26 and through hole 71 in flat spring 72 (whose function is to press plate 26 against plate 24) and into engagement with flat spring 74. In its projected position pin 54 thus prevents the insertion of a properly coded guest key or master key between plates 24, 26. Fixedly secured centrally of flat spring 74 is an elongated indicator pin 76 which is normally received at its outer end in a hole 78 formed in the outer vertical wall 80 of housing 12. It will be apparent from FIG. 1 that upon depression of tail piece 16, pin 76 will be projected to the dot-dash position of FIG. 1 indicating that the lockset is locked from the inside. As is well known in the art, a detent (not shown) is provided in the inner knob structure to hold the tail piece in depressed position until the inner knob is turned to unlock the lockset or a spanner wrench is used to release the knob button. Upon release of the inner knob button the tail piece 16 is released so that the same is projected to the left by spring 70 clearing the key slot and permitting the flat spring 74 to which the indicator pin 76 is secured to return to its original position with the indicator pin 76 received within hole 78.

It will be understood that not only does the inner pin 54 project the outer pin 76 to occupancy indicating position, but it also extends between plates 24, 26, thus physically preventing full insertion of a conventional guest key or maid's key into the lockset. A special emergency key for unlocking the lockset despite the projected pin 54 will subsequently be described.

Another important feature of the instant invention is the provision of means for changing the combination of the lockset from outside the housing as noted above. The structure for providing this feature will now be described.

Referring to FIGS. 2, 3 and 6 the core 18 is provided with a cylindrical well 81 to receive a cylindrical plug generally designated 82 which may be formed of non-magnetizable material such as brass. This plug 82 may be rotated to a plurality of predetermined positions and is provided with an axially extending bore 84 which receives therein a locking pin 86 (FIG. 3). In order to hold the plug 82 in a predetermined position a radially extending bore 88 is provided in said plug for receiving therein a compression spring 100. This spring 100 urges a ball 102 radially outwardly of the plug 82 into frictional engagement with the sidewall of well 81. At spaced points around the wall of well 81 arcuate grooves 104 are provided for receiving the ball 102 therein. In the example shown in FIG. 3 four such grooves are formed in core 18 so as to permit positioning plug 82 in any one of four predetermined positions. A key properly coded to unlock the lock must also contain in addition to the normal unlocking spots an additional spot to repel magnet 86 in rotatable plug 82.

For turning the plug 82 a tool generally designated 106 (see FIG. 6) is provided which is formed with a noncircular end adapted to be received within a complementarily formed hole 108 at the center of plug 82. The shank 107 of tool 106 extends through an opening 110 in outer wall 80 of housing 12 and under flat springs 72, 74. Plates 24, 26 are provided with openings 116, 118 and locking plate 28 is provided with an opening 120 for receiving therethrough said shank 107.

At this point it will be noted that the combination of the lockset may be changed from outside the lockset using tool 106 to rotate plug 82 so that magnet pin 86 takes up a different position so as to register with another corresponding hole in locking plate 28. Such corresponding holes are shown at 105 A, B, C, D in FIG. 2.

By the structure of the present invention the shank 107 of tool 106 can be made to register with the hole 108 in plug 82 only when the core 18 has been depressed to a predetermined position by a properly coded key. However, it is further desirable that a key capable of only unlocking the mechanism does not move core 18 sufficiently to permit registration between hole 108 and shank 107. If an unlocking guest key were capable of effecting such registration it might be possible to drill a hole through the key at the correct location and be able to change combination of the mechanism by inserting a tool through hole 110 and through the hole in the key and into the plug. To achieve the desired security an additional magnet pin 130 (FIGS. 1, 2, 3) is provided in core 18 and which pin is normally attracted to metallic plate 26 through a vertically elongated hole 132 in locking plate 28. A key properly coded to operate the lock, but not to change the code, contains a spot 136 on a key generally designated 138 as shown in FIG. 4. Said spot 136 on key 138 is of opposite polarity relative to the adjacent end of magnetic pin 130 and therefore attracts the pin more firmly into locking hole 132. When a properly coded key also containing spot 36 is inserted into the lockset slot it will allow magnet core 18 to be pushed downwardly only to the limit of travel allowed by elongated locking hole 132. When the pin 130 engages the bottom of slot 132 it prevents further downward movement of slidable core 18 with the latter in a position not permitting registration of the shank 107 of the tool 106 with the hole 108 in plug 82.

Referring now to FIG. 5 which shows a code change key generally designated 142. This code change key in addition to the proper unlocking code, is provided with a magnetic spot 144 having the same polarity as the adjacent end of pin 130 so that upon insertion of code change key 142 the pin 130 is repelled from elongated hole 132 permitting the core 18 to be translated downwardly past its previous limited position so that the hole 108 in plug 82 is in registration with the inserted shank 107 of tool 106.

In order to make the key 142 of FIG. 5 a fully effective code changing master key the same can be provided with magnetic spots 143 A, B, C and D all of the same polarity as the adjacent end of pin 86 so that upon insertion of key 142 in the lockset the pin 86 will be repelled into plug 82 regardless of its particular position. Key 142 is also provided with an opening 145 through which the shank 107 of tool 106 may be inserted when the core 18 has been moved to its predetermined code changing position.

Referring back again to the key 138 of FIG. 4, if the inner pin 54 of the occupancy indicator is across the key receiving slot the lockset may still be unlocked by providing the key 138 with an elongated slot 150 for receiving therein pin 54 and thus permit the properly coded key 138 to depress the core 18 to its unlocking position. This type of key is normally called an emergency key.

Another key which may be employed for the same purpose as key 138 of FIG. 4 is that shown in FIG. 7. In this case greatly added security may be effected in an emergency key by forming the key in more than one piece. For example, each piece may be in the custody of different persons so that joint action by such persons is required to permit unlocking of the lockset when the latter has been locked from inside the door. In the example given in FIG. 7 three parts 152, 153 and 154 are shown, and it will be apparent that when said parts are placed together an emergency key may be formed with the same spot 136 indicated in FIG. 4. In addition, part 153 may be cut away as indicated at 156 so that when the parts are connected a slot is formed which is adapted to receive inner pin 54 therethrough. This emergency key may be used by first inserting part 152 into the lockset slot and then inserting part 153 hooking the lower end of the latter around pin 54 and then completing the assembly by inserting part 154. It will be apparent that carefully dividing the magnetic key into parts does not appreciably affect the operation of its code in the mechanism.

A particular advantage derivable from the use of the key of FIG. 7 is that a magnetic spot 160 may be applied to the key in part 153 and between the slot 156 and the leading edge of the key to operate with a locking pin at that location. This gives an advantage over the key 138 of FIG. 4 since the formation of a slot 150 would remove the magnetic spot 160, preventing unlocking.

Although only one carrier for the code changing pin 84 has been described in the form of plug 82, it will be apparent that additional carriers or plugs may be provided to increase the possible number of combinations to which the lockset may be changed. Furthermore, a plurality of plugs may be interconnected by teeth to form a gear train to permit a plurality of plugs to be moved by moving one.

The present invention also contemplates other means for rotating the code changing plug in addition to inserting a tool through a hole in the housing.

I claim:

1. In a magnetic key actuated lock structure that includes a housing, a slidable core in said housing adapted to be translated from a locking position to an unlocking position by a magnetically coded key and a locking plate alongside said core provided with apertures for receiving locking pins therein from said core, the improvement that comprises:

a locking pin carrier carried by said core and slidably supporting a code changing locking pin therein, a tool operable from outside said housing for moving said carrier and said code changing pin relative to said core for changing the code of said lock structure.

2. A structure according to claim 1 wherein said carrier is rotatably supported in said core and said code changing pin is spaced from the axis of rotation of said carrier.

3. A structure according to claim 2 wherein said housing is formed with an aperture for receiving said tool therethrough for rotating said carrier.

4. A structure according to claim 1 wherein said tool and said carrier are provided with interengaging elements which, when engaged, permit said movement of said carrier by said tool, means preventing engagement of said elements except when said core is moved to a predetermined position.

5. A structure according to claim 4 wherein a code change key is provided for moving said core to code changing position, said code change key being formed with an opening to permit passage of said tool therethrough.

6. A structure according to claim 1 wherein means is provided for releasably fixing said carrier and said code changing pin at a plurality of predetermined positions relative to said core, and a code changing key provided with a magnetic spot adapted to move said code changing pin to unlocking position at any of said predetermined positions of the latter.

7. A structure according to claim 1 wherein said structure includes a pair of members having adjacent planar faces between which a key is adapted to be positioned for unlocking said structure, an occupancy indicator device in said structure including a shut out element adapted to extend between said faces to prevent insertion of a properly coded key, an emergency key for use in said structure and including a properly coded arrangement of spots for unlocking the structure, said emergency key being formed with an opening for receiving said element therein to permit insertion of said emergency key to unlocking position in said structure.

8. A structure according to claim 7 wherein said emergency key is formed in a plurality of parts adapted to be inserted seriatim in said structure and combinable to form said opening in said emergency key.

9. A structure according to claim 8 wherein said key is in three separable parts.

10. In a magnetic key operated lockset, an occupancy indicator structure therefor, including a housing, said housing including a tail piece, a slidable core containing locking elements, and a pair of plates between which a magnetic key may be inserted, the improvement that comprises:

first and second pins slidable axially of said structure, said core being formed with an opening receiving said first pin therethrough, said first pin being operatively connected to said tail piece for axial movement of said first pin upon depression of said tailpiece, means mounting said second pin for axial movement in response to said axial movement of said first pin, said housing having an outer wall adapted to receive one end of said second pin therethrough upon depression of said tail piece, one of said plates being provided with an opening for receiving said first pin therethrough for blocking the entry of such magnetic key when said tail piece is depressed.

11. In a structure according to claim 10, an emergency key adapted to unlock said lockset when said tail piece is depressed, said emergency key being formed with an opening for receiving said first pin therein to permit unlocking of said lockset.

12. A structure according to claim 11 wherein said key includes a magnetic spot at a point between the leading edge of said key and said opening.

13. A structure according to claim 11 wherein said opening comprises an elongated slot extending in the direction of travel of said key when inserted in said housing.

14. A magnetic key for use with a magnetic key operated lockset which includes an occupancy indicator structure having an axially movable pin:

said key being formed with an opening for receiving said pin therethrough, said key being formed in a plurality of separable parts for insertion seriatim in such lockset.

15. A magnetic key according to claim 14 wherein said opening is formed by combining said plurality of parts.

16. A magnetic key according to claim 15 wherein said key includes a magnetic spot at a point between said opening and the leading edge of said key as the latter is inserted in said lockset.

17. In a magnetic key operated lockset, an occupancy indicator structure including an axially moveable pin, a magnetic key for operating said lockset, said key being formed with an opening for receiving said pin therethrough.

18. A magnetic key according to claim 17 wherein said opening comprises an elongated slot extending in the direction of travel of said key when inserted in said housing.

19. In a magnetic key operated lockset having a housing, said housing including a tail piece, a slidable core containing locking elements, and a pair of plates between which a magnetic key may be inserted, a lockout structure for said lockset comprising:

a pin slidable axially of said housing, said core being formed with an opening receiving said pin therethrough, said pin being operatively connected to said tail piece for axial movement of said pin to a position between said plates upon depression of said tail piece to thereby exclude such magnetic key.

20. A lockset according to claim 19 wherein a second pin is mounted for axial movement in response to axial movement of said first mentioned pin, said housing having an outer wall adapted to receive one end of said second pin therethrough upon depression of said tail piece.

* * * * *